US010113385B2

(12) United States Patent
Nguyen et al.

(10) Patent No.: US 10,113,385 B2
(45) Date of Patent: Oct. 30, 2018

(54) PRODUCTION SYSTEM AND TENSION HANGER

(71) Applicant: Cameron International Corporation, Houston, TX (US)

(72) Inventors: Dennis P. Nguyen, Houston, TX (US); Tyler Loudon, Houston, TX (US)

(73) Assignee: Cameron International Corporation, Houston, TX (US)

( * ) Notice: Subject to any disclaimer, the term of this patent is extended or adjusted under 35 U.S.C. 154(b) by 222 days.

(21) Appl. No.: 14/485,553

(22) Filed: Sep. 12, 2014

(65) Prior Publication Data

US 2016/0076329 A1 Mar. 17, 2016

(51) Int. Cl.
*E21B 33/04* (2006.01)
*E21B 34/10* (2006.01)

(52) U.S. Cl.
CPC ..... *E21B 33/0415* (2013.01); *E21B 34/10* (2013.01)

(58) Field of Classification Search
CPC ..... E21B 33/0415
USPC ..... 166/75.14
See application file for complete search history.

(56) References Cited

U.S. PATENT DOCUMENTS

| | | | | |
|---|---|---|---|---|
| 4,278,278 | A | 7/1981 | Chambless et al. | |
| 4,496,172 | A * | 1/1985 | Walker | E21B 33/038 285/18 |
| 4,601,343 | A * | 7/1986 | Lindsey, Jr. | E21B 17/06 166/242.6 |
| 5,139,090 | A | 8/1992 | Land | |
| 6,571,877 | B1 * | 6/2003 | Van Bilderbeek | E21B 33/03 166/339 |
| 2005/0263293 | A1 | 12/2005 | Tessier et al. | |
| 2011/0226488 | A1 | 9/2011 | Garcia | |
| 2014/0151069 | A1 * | 6/2014 | Kajaria | E21B 33/047 166/382 |

OTHER PUBLICATIONS

International Search Report and Written Opinion dated Oct. 26, 2015 for PCT Application PCT/US2015/045749 filed on Aug. 18, 2015 (14 pages).

* cited by examiner

*Primary Examiner* — Giovanna C. Wright
*Assistant Examiner* — Kristyn A Hall
(74) *Attorney, Agent, or Firm* — Chamberlain Hrdicka

(57) ABSTRACT

A hanger system is disclosed for supporting a production tubing string in a well. The system includes a hanger body with an inner bore extending through the body along an axis. The system also includes an inner mandrel attachable to the production tubing string and passable from the hanger body inner bore. The inner mandrel is also engageable with the hanger body by rotation of the inner mandrel. Further, the inner mandrel is movable into a landed position by axial, non-rotational movement of the inner mandrel relative to the hanger body.

20 Claims, 9 Drawing Sheets

PRODUCTION SYSTEM AND TENSION HANGER

BACKGROUND

The advance of hydraulic fracturing in North America has given rise to certain wellhead equipment and services. Production decline rates of many frac wells often lead to the use of artificial lift after a period of initial flowback and production. A frequent method of artificial lift implemented is a rod pump. In this case, the tubing string is placed in tension, helping align the string to prevent contact and wear between the outer diameter of the rod and the inner diameter of the tubing. This tension can be achieved by using a tension hanger.

A tension hanger is fundamentally a two piece mandrel hanger, with an inner mandrel bushing connection to a parent body housing. Typically the hanger is initially landed in the bowl. At this point the landing position of the tubing is marked at the top of the BOP. The inner mandrel and parent body connection is then broken, allowing the mandrel to run downhole for the setting of the packer, while the parent body remains in the bowl. Once the packer is set, the mandrel is raised back up and reconnected to the parent body with the string now in tension, with the final landing position matching the initial, confirmed by the tubing marked at the top of the BOP.

As an alternative to a mandrel, a string can be put in tension with slips, or connected directly to the adapter with an iterative process using specific length pup joints, but either does not permit the use of a back pressure valve, a growing and often customer mandatory preference. The recent increase in the shale drilling activity, combined with typical rapid production decline rates, makes a new well likely to soon require artificial lift, and in turn, putting the string in tension.

BRIEF DESCRIPTION OF THE DRAWINGS

For a detailed description of the preferred embodiments of the invention, reference will now be made to the accompanying drawings in which.

DETAILED DESCRIPTION

Figure 1:
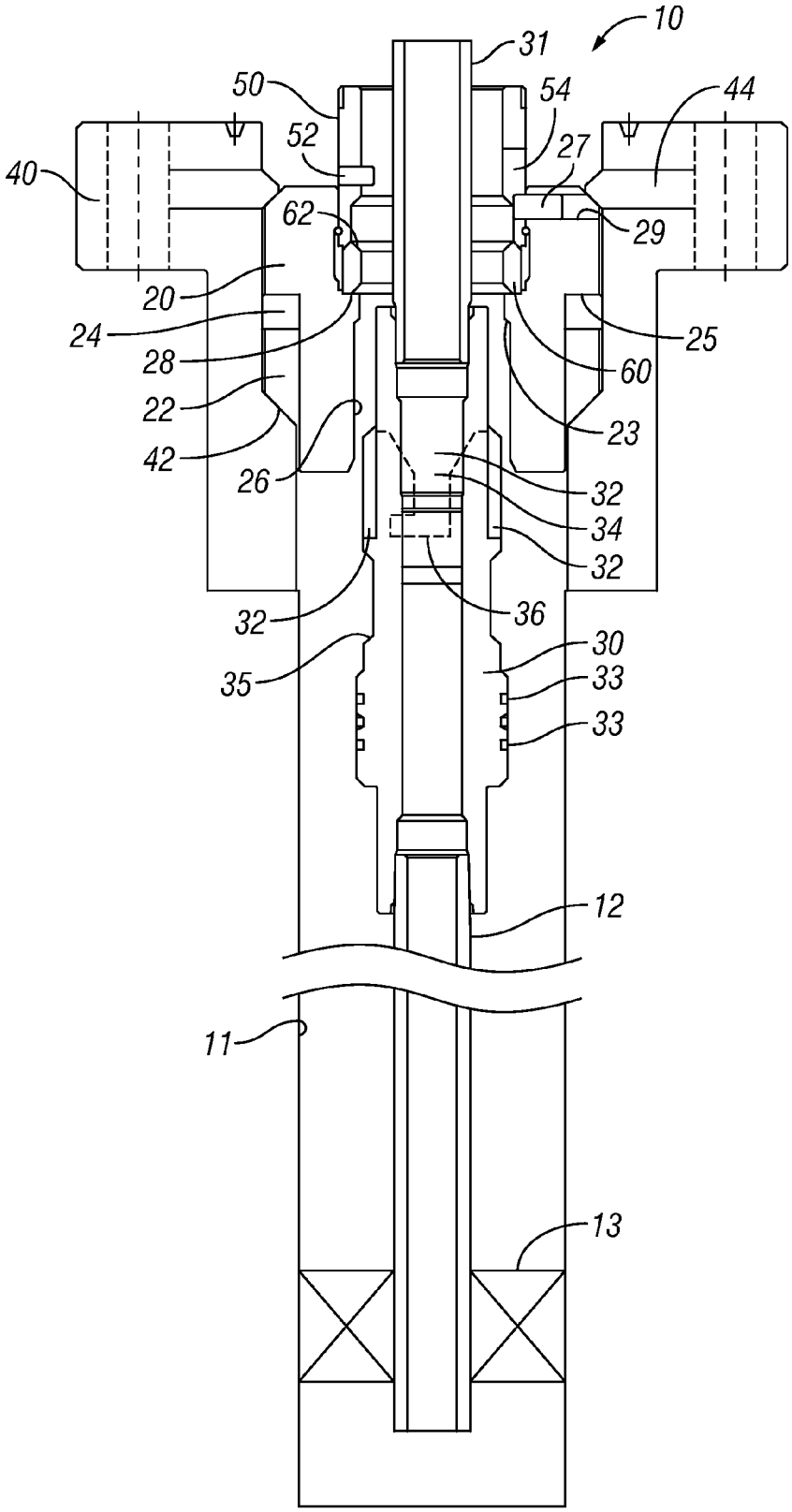
FIG. 1 shows a well production system with an embodiment of a hanger system.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function, unless specifically stated. In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Referring now to FIG. 1, a hanger system 10 is shown for supporting a tubing string 12 with at least one sealing packer 13 in a well 11. The system 10 includes a hanger body 20 and an inner mandrel 30 that are supported in a wellhead component 40. The wellhead component 40 may be any component suitable for supporting the hanger system 10 and the tubing string 12, such as without limitation a tubing spool. The wellhead component includes an inner bore with an upwardly facing shoulder 42 for supporting the hanger system 10.

The hanger body 20 includes a landing ring 22 and a seal 24 around its exterior surface that abuts a downwardly facing shoulder 25 of the hanger body 20. The hanger body 20 and the landing ring 22 are sized such that the hanger body 20 can land in and be supported in the wellhead member 40 by engaging the wellhead member shoulder 42. Although the landing ring 22 and seal 24 are shown as a separate elements than the hanger body 20, either one or both the landing ring 22 and the seal 24 may be integral with the hanger body 20. The hanger body 20 also includes an inner bore 26 extending therethrough along an axis in the vertical orientation as shown in FIG. 1. Included in the inner bore is an upwardly facing shoulder 28 described in further detail below. The hanger body 20 further includes an orientation means such as guide pin 27, which is extendable and retractable in channel 29. Below the upwardly facing shoulder 28 is a downwardly facing shoulder 23 that can serve as an upward stop and is explained further below.

The hanger system 10 further includes an inner mandrel 30 attachable to the tubing string 12 such as by a threaded connection as shown. The inner mandrel 30 is passable from inside the hanger body inner bore 26 into the well 11 below the hanger body 20 as shown in FIG. 1. Before being connected with the hanger body 20, the inner mandrel is supported and positioned by a running tool 31 that extends through the hanger body inner bore 26. As explained in more detail below, the inner mandrel 30 includes a slot or slots 32 on the exterior surface of the inner mandrel 30. If multiple slots 32 are included, they can be spaced azimuthally around the inner mandrel 30. In the embodiment shown in FIGS. 1-6, each slot 32 comprises a "J" slot with an axially oriented portion 34 aligned with the same axis of the hanger body inner bore 26 and an azimuthally oriented portion 36 extending at least partially around the inner mandrel 30. However, the slots 32 may comprise other configurations suitable for the hanger system 10 in other embodiments. The inner mandrel 30 may also include seals 33 on the exterior surface. Optionally, the seals 33 may be included on a portion of increased outer diameter sized for the seals 33 form a seal against the inner bore 26 of the hanger body 20 when the inner mandrel 30 is landed in the hanger body 20. The inner mandrel 30 may further include an upwardly facing shoulder 35 either as part of the portion of increased diameter as shown or otherwise. The upwardly facing shoulder 35 is designed to interact with the downwardly facing shoulder 23 of the hanger body 20 so to be an upward stop for the inner mandrel 30. When the two shoulders are engaged, the position of the inner mandrel 20 relative to the load pin(s) 52 is known.

The hanger system 10 further includes a sleeve 50 that is receivable into the hanger body inner bore 26 and includes a load pin 52 extended into the interior of the sleeve 50. As shown in FIGS. 1-6, the inner, hollow portion of the sleeve 50 is large enough to allow passage of at least some of the running tool 31 and at least some of the inner mandrel 30. Additionally, the sleeve includes an axially oriented guide slot 54. When the sleeve 50 is in position on the hanger body 20, the guide pin 27 is extended into the guide slot 54 so that the sleeve 50 is restrained from rotation relative to, but is allowed to move axially relative to, the hanger body 20. Thus, with the guide pin 27 extended into the guide slot 54, the sleeve 50 may move up and down relative to the hanger body 20 but cannot rotate relative to the hanger body 20.

As show in FIG. 1, below the sleeve 50 is a ring 60 that is collapsible radially inward to create a load shoulder on an inner surface 62. The ring 60 may be a segmented ring or any other suitable type of ring that can be collapsed inward to create a load shoulder capable of supporting the inner mandrel 30 and the tubing string 12 as discussed below.

With reference to FIGS. 1-6, an installation and landing sequence for the hanger system 10 will now be described. As shown in FIG. 1 and discussed above, the hanger body 20 is landed in the wellhead component 40 by engaging the landing ring 22 with the upwardly facing shoulder 42. When landed, the hanger body can be locked in place in the wellhead component 40 using a locking mechanism 44, such as a tie down screw, lock ring, lockscrew, snap ring, or any other suitable locking mechanism. Run concurrently with or separately from the hanger body are the inner mandrel 30 and production tubing 12 on the running tool 31 as well as the sleeve 50 and ring 60. Either before or after landing the hanger body 20 in the wellhead member but before landing the inner mandrel 30, the guide pin 27 is placed within the guide slot 54 of the sleeve 50. If not already disengaged from the sleeve 50 and the hanger body 20, the inner mandrel 30 is disengaged and passed from within the hanger body 20 into the well 11 below the hanger body 20 as shown in FIG. 1. The inner mandrel 30 is lowered until the packer 13 is located its designated position within the well 11, where the packer 13 is then set to seal the annulus surrounding the production tubing 12 as well as anchor the production tubing 12 in the well 11.

Figure 2:
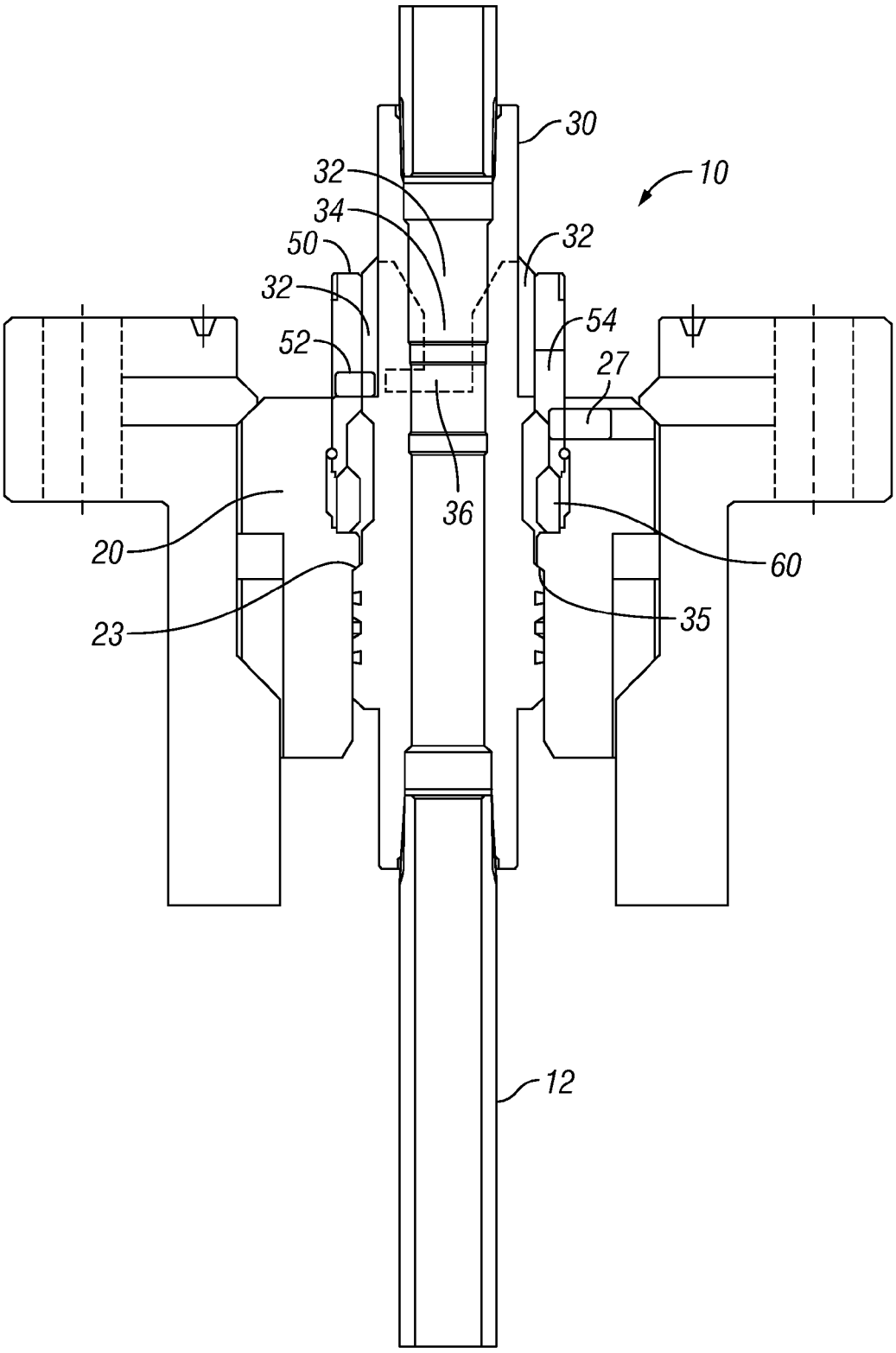
FIG. 2 shows a cross section view of the embodiment of the hanger system in FIG. 1.
Figure 3:
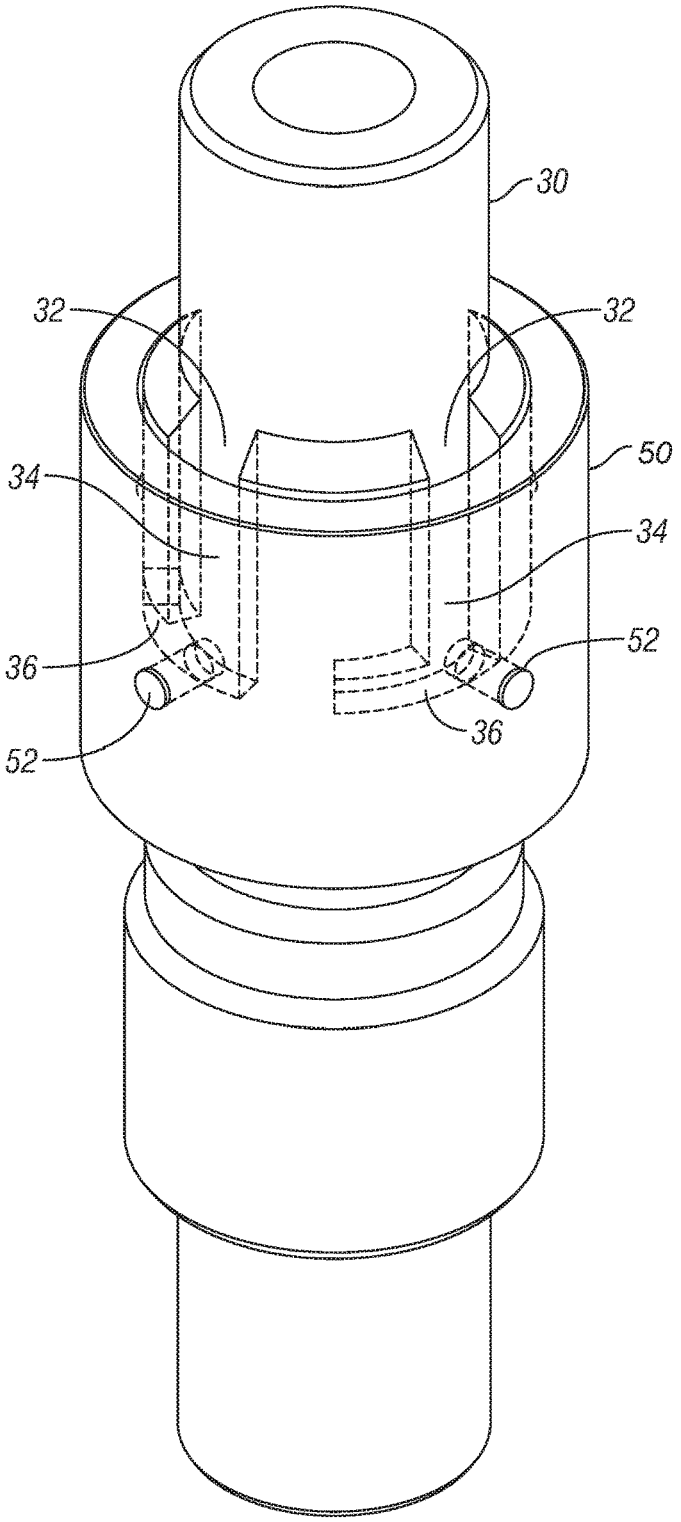
FIG. 3 shows a perspective view of the embodiment of the hanger system in FIG. 1.
Figure 4:
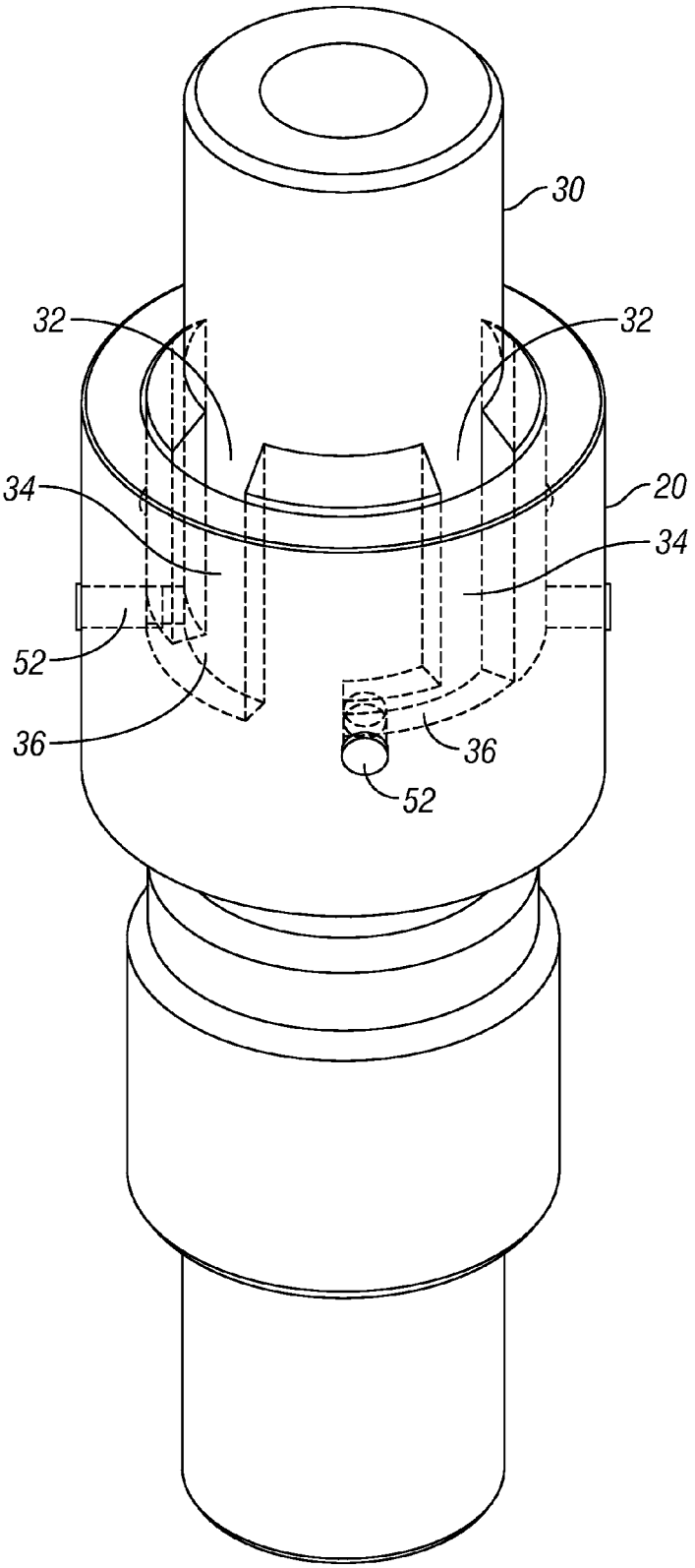
FIG. 4 shows another perspective view of the hanger system in FIG. 1.

As shown in FIG. 2, the running tool 31 is then used to raise the inner mandrel 30 into the hanger body 20 as well as the sleeve 50, placing the production tubing 12 in tension. The inner mandrel 30 is raised in an orientation such that the load pin(s) 52 is inserted into the slot 32 or one of the slots 32 in the inner mandrel 30 such that the inner mandrel 30 is engaged with the sleeve 50 and thus the hanger body 20. The inner mandrel 30 is raised by moving axially relative to the hanger body 20 with the load pin 52 travelling within the axially oriented portion 34 of the slot 32 until the upwardly facing shoulder 35 of the inner mandrel 30 engages the downwardly facing shoulder 23 of the hanger body 20. When engaged, it is known that the load pin has reached the azimuthally oriented portion 36 of the slot 32 as shown in FIG. 3. With the load pin 52 in the azimuthally oriented portion 36 of the slot 32, the running tool 31 is then used to rotate the inner mandrel 30 relative to the sleeve 50 as shown in FIG. 4 to cause the load pin 52 to travel into the azimuthally oriented portion 36 of the slot 32 and out of the axially oriented portion 34. With the guide pin 27 extended into the guide slot 54, the sleeve 50 is prevented from rotation relative to the hanger body 20 and thus the inner mandrel 30 is also rotated relative to the hanger body 20. In the embodiment shown in FIGS. 1-6, but not necessarily all embodiments, the azimuthally oriented portion 36 of the slot 32 allows for the inner mandrel 30 to be rotatable without axial movement relative to the hanger body 20. Thus, the inner mandrel 30 is engageable with the hanger body 20 by rotation of the inner mandrel 30.

Figure 5:
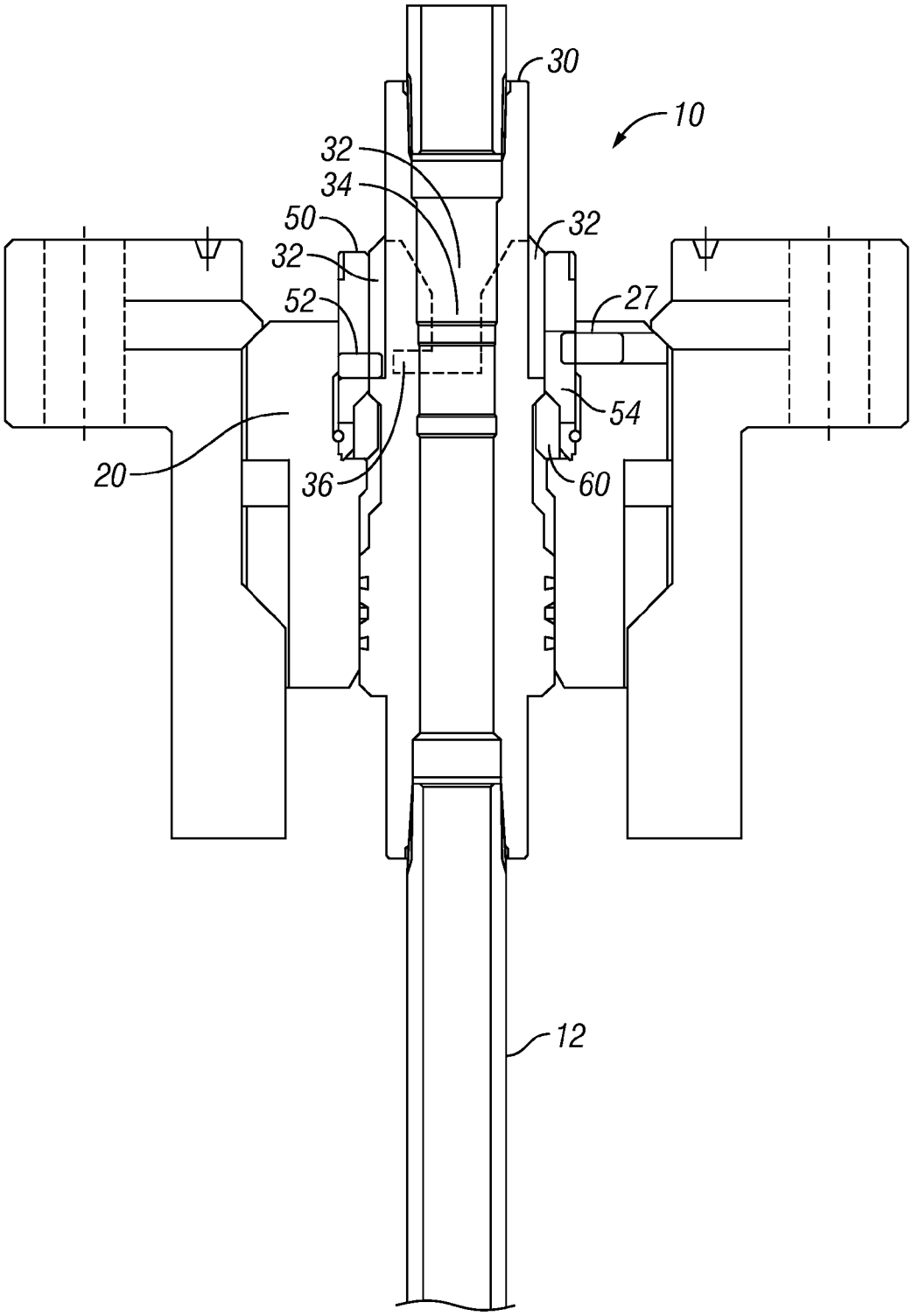
FIG. 5 shows a cross section view of the embodiment of the hanger system in FIG. 1.

As shown in FIG. 5, the inner mandrel 30 is movable into a landed position by axial, non-rotational movement of the inner mandrel 30 downward relative to the hanger body 20. Because the production tubing string 12 is anchored in position with the packer 13, raising the inner mandrel as shown in FIG. 1 places the production tubing 12 in tension. Downward movement of the inner mandrel 30 thus is accomplished by lowering the inner mandrel 30 on the running tool 31. However, the production hanger system 10 and production tubing 12 may be engineered such that even with the inner mandrel 30 in the landed position, the production tubing string 12 remains in tension. Because the load pin 52 is in the azimuthally oriented portion 36 of the slot 32, axial movement of the inner mandrel 30 downward relative to the hanger body 20 also moves the sleeve 50 axially downward relative to the hanger body 20. Thus, the sleeve 50 is movable axially upon axial movement of the inner mandrel 30 with the load pin 52 inserted in the slot 32. The axial travel is allowed by the axial travel of the guide pin 27 in the guide slot 54 of the sleeve 50. Axially downward travel of the sleeve 50 causes an angled surface on the lower portion of the sleeve 50 to engage a corresponding angled surface or surfaces on the upper portion of the collapsible ring 60. Further downward movement of the sleeve 50 applies a force to the ring 50. However, because the ring 50 is prevented from downward axial movement due to the shoulder 28 of the hanger body 20, downward movement of the sleeve 50 moves the sleeve 50 over the ring 60. Doing so collapses the ring 50 radially inward to create a shoulder to support the inner mandrel 30 in the landed position as shown. Also as shown, the inner mandrel may be engineered such that the load pin 52 in the azimuthally oriented portion 36 of the slot 32 combines with the support shoulder of the ring 50 to prevent axial movement of the inner mandrel 30 relative to the sleeve 50 and the ring 60 when in the landed position shown.

Figure 6:
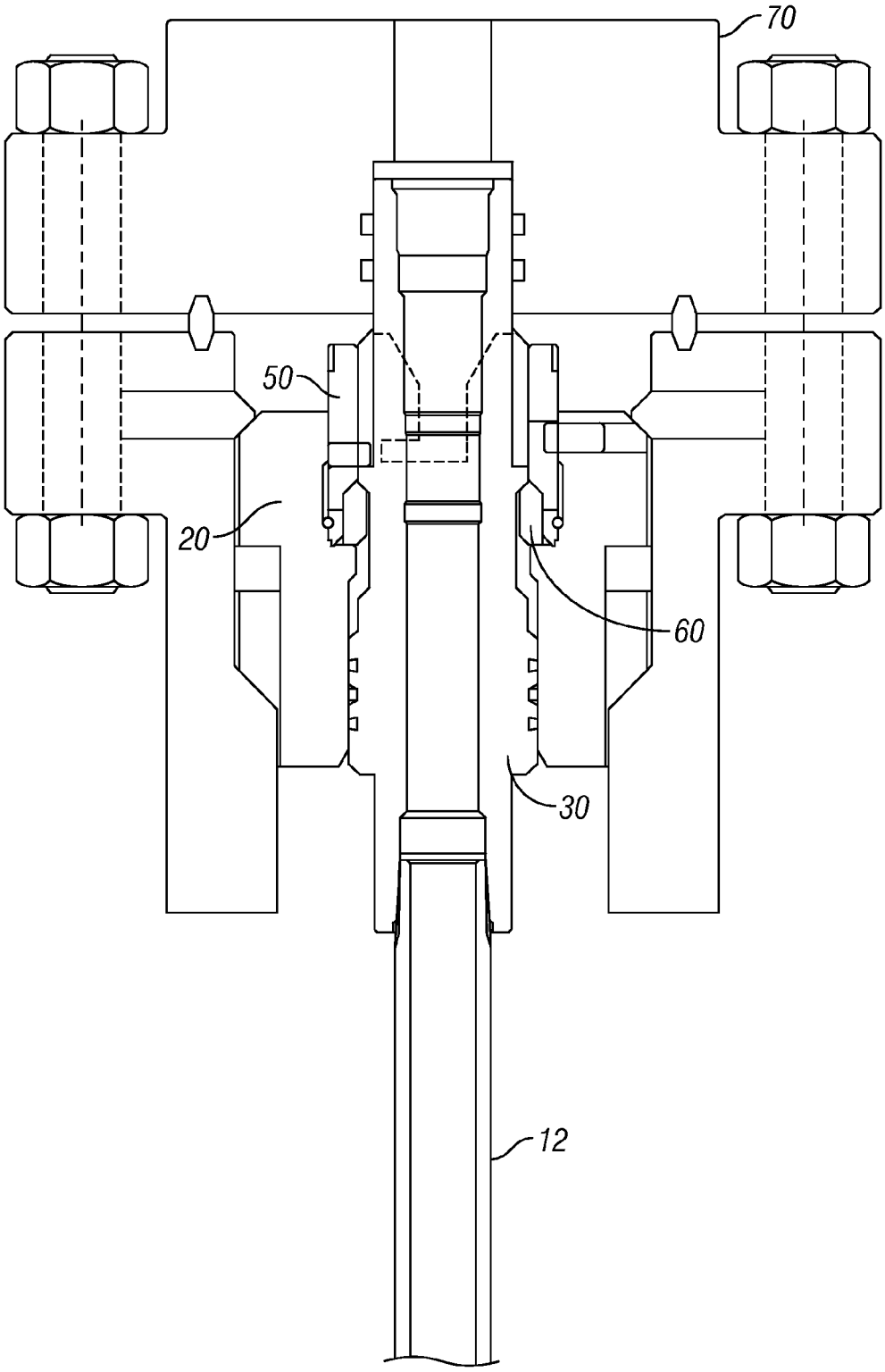
FIG. 6 shows a cross section view of the embodiment of the hanger system in FIG. 1.

As shown in FIG. 6, once the inner mandrel 30 is landed in the hanger body 20, a seal flange 70 or other element may be connected with the wellhead component 40 to lock the inner mandrel 30 in the landed position.

Figure 7:
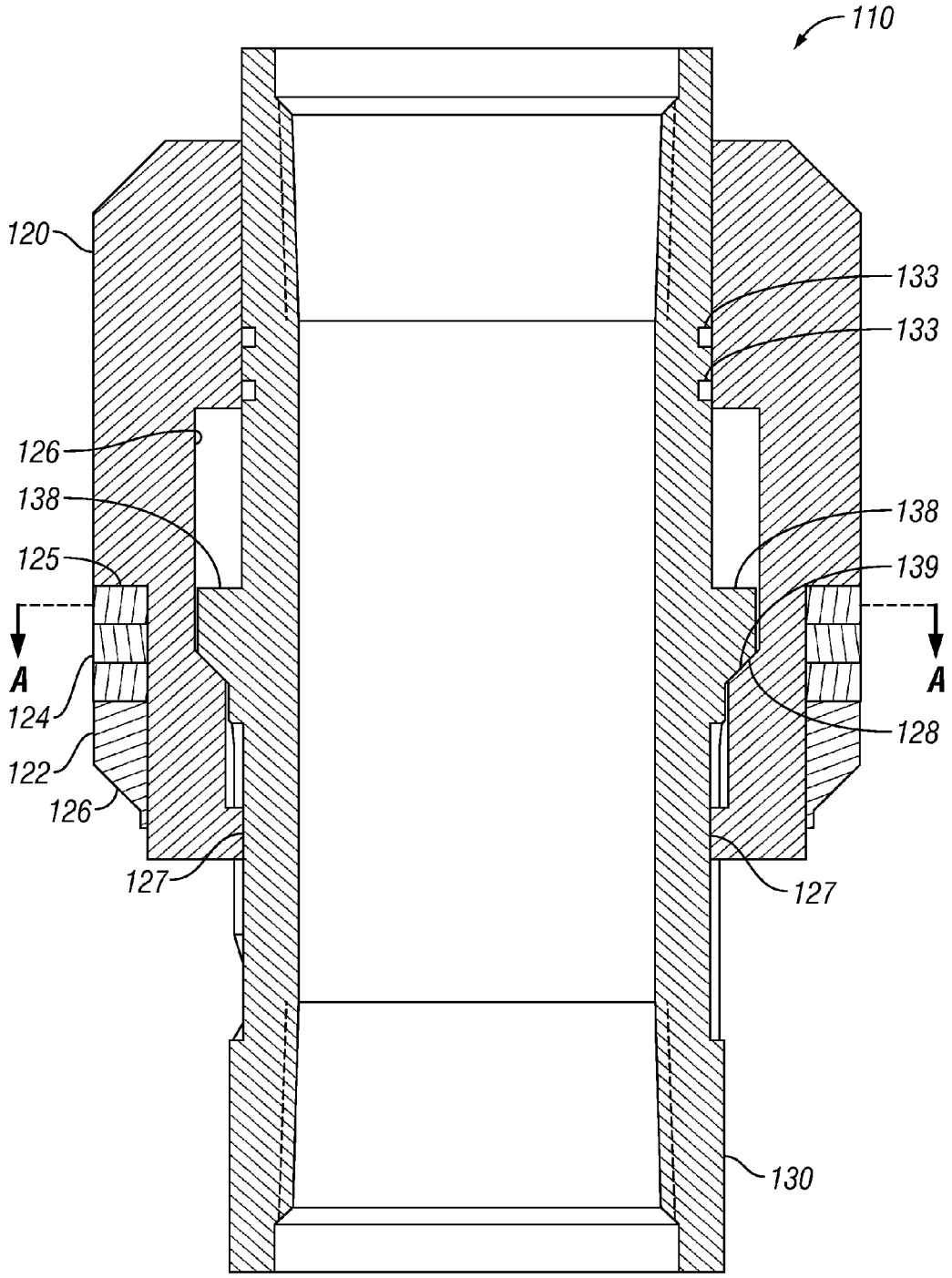
FIG. 7 shows another embodiment of a hanger system.
Figure 8:
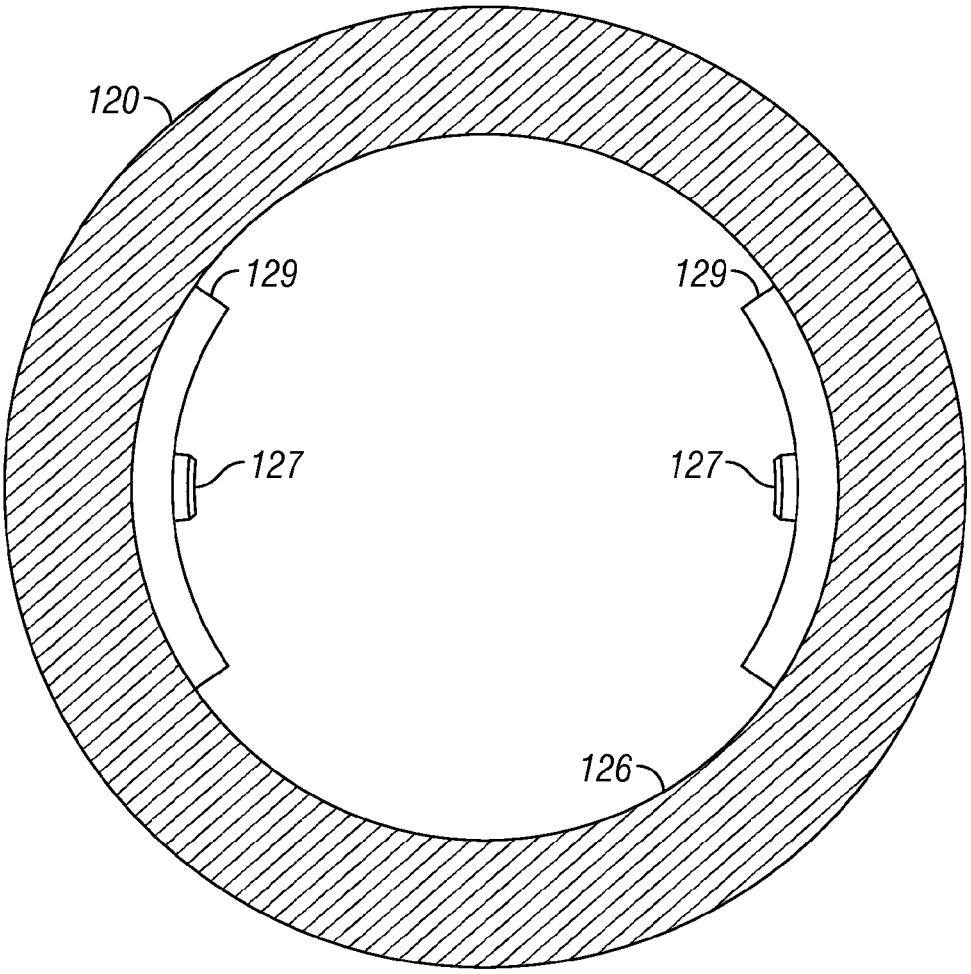
FIG. 8 shows a view of the plane A-A shown in FIG. 7.
Figure 9:
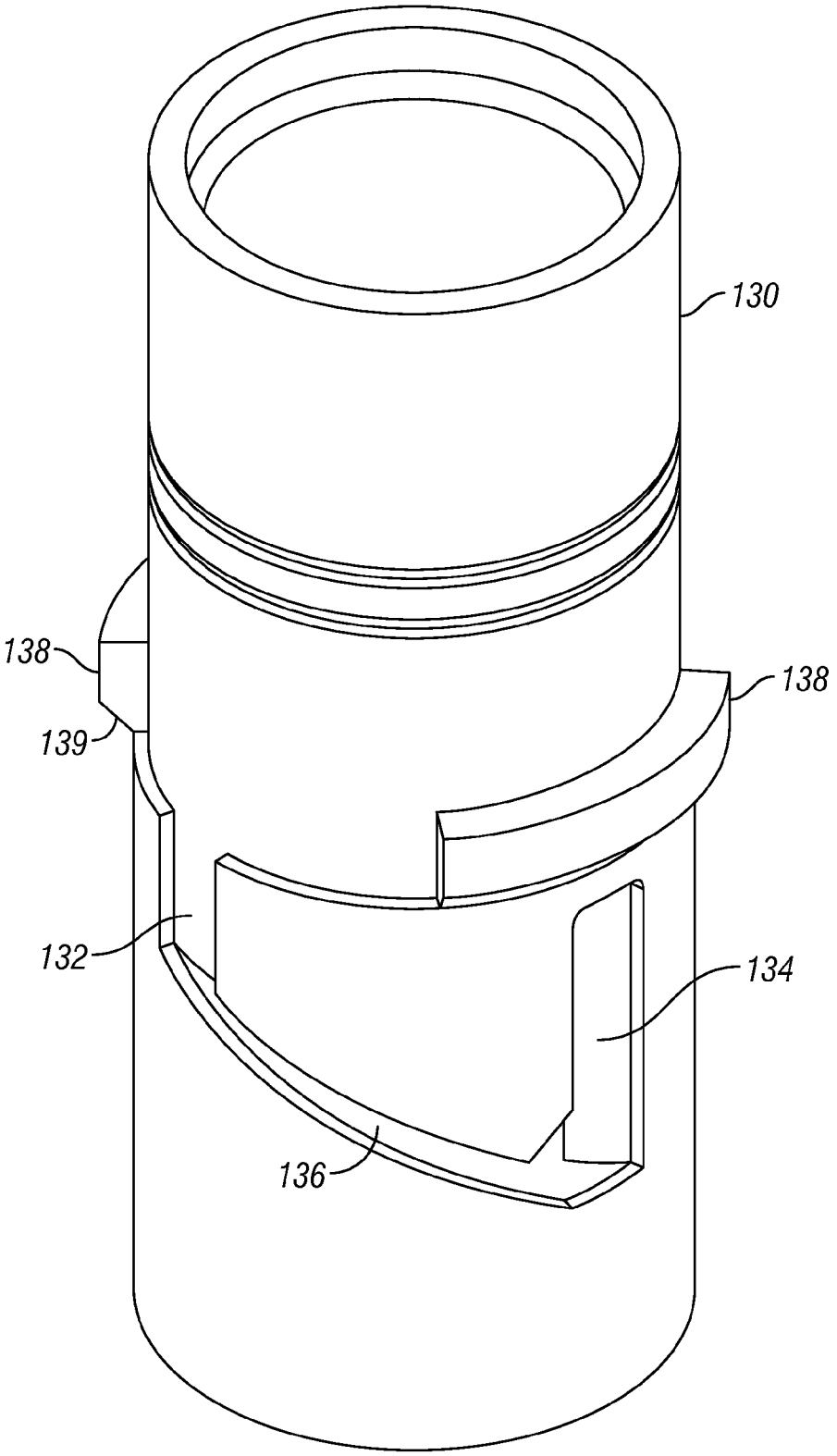
FIG. 9 shows a perspective view of a portion of the embodiment of the hanger system of FIG. 7.

A second embodiment of a hanger system 110 is shown in FIGS. 7-9. Although not shown, the hanger system 110 is also used for supporting a tubing string with at least one sealing packer in a well as shown in FIG. 1. The system 110 includes a hanger body 120 and an inner mandrel 130 that are supported in a wellhead component (not shown). The wellhead component may be any component suitable for supporting the hanger system 110 and the tubing string, such as without limitation a tubing spool. The wellhead component includes an inner bore with an upwardly facing shoulder for supporting the hanger system 110 similar to the wellhead component 40 shown in FIGS. 1-6.

The hanger body 120 includes a landing ring 122 and a seal(s) 124 around its exterior surface that abuts a downwardly facing shoulder 125 of the hanger body 120. The hanger body 120 and the landing ring 122 are sized such that the hanger body 120 can land in and be supported in the wellhead member by engaging a wellhead member shoulder. Although the landing ring 122 and seal 124 are shown as a separate elements than the hanger body 120, either one or both the landing ring 122 and the seal 124 may be integral with the hanger body 120. The hanger body 120 also includes an inner bore 126 extending therethrough along an axis in the vertical orientation as shown in FIG. 7. Included in the inner bore 126 is an upwardly facing shoulder 128 described in further detail below. As best shown in FIG. 8, the hanger body 120 further includes a body segment or segments 129 extending into the inner bore 126. Each segment 129 does not extend completely around the inner bore 126 of the hanger body 120. If more than one body segment is used (as shown), the body segments 129 may be spaced apart from each other such that there are gaps between the body segments 129. If only one body segment 129 is used, it may extend more than halfway around the inner bore 126 but would not extend completely around. The hanger body 120 also includes an orientation means such as load pin(s) 127. Although there are two load pins 127 shown in FIGS. 7 and 8 and each are directly aligned with a body segment 129, there can be any number of load pins 127 and they may not be directly aligned with a body segment 129.

The hanger system 110 further includes an inner mandrel 130 attachable to the tubing string such as by a threaded connection. As with the hanger system 10 embodiment, the inner mandrel 130 is passable from inside the hanger body inner bore 126 into the well below the hanger body as will be explained further below. Before being connected with the hanger body 120, the inner mandrel may be supported and positioned by a running tool (not shown) that extends through the hanger body inner bore 126. As explained in more detail below, the inner mandrel 120 includes a slot or slots 132 on the exterior surface of the inner mandrel 130. If multiple slots 132 are included, they can be spaced azimuthally around the inner mandrel 130. In the embodiment shown in FIGS. 7-9, each slot 132 comprises an axially oriented portion 134 aligned with the same axis of the hanger body inner bore 126. Each slot 132 further includes a helically oriented portion 136 continuous with the axially oriented portion 134 and extending helically at least partially around the inner mandrel 130. However, the helically oriented portion 134 of the slot 132 need not and preferably does not extend completely around the outer surface of the inner mandrel 130. Additionally, the slots 132 may comprise other configurations suitable for the hanger system 110 in other embodiments. The inner mandrel 130 may also include seals 133 on the exterior surface. The seals 33 may be included on a portion of the inner mandrel 130 sized for the seals 33 form a seal against the inner bore 126 of the hanger body 120 when the inner mandrel 130 is landed in the hanger body 120. The inner mandrel 130 further includes a mandrel segment or segments 138 extending from an exterior surface of the inner mandrel 130. The mandrel segment(s) 138 are sized and spaced to pass through the space(s) in the body segment(s) 129 in a certain orientation. However in other rotational orientations, the mandrel segment(s) 138 are sized and spaced to engage the body segment(s) 129. For engagement, the mandrel segments 138 include a downwardly facing shoulder 139 corresponding to the upwardly facing shoulder 128 of the hanger body 120.

With reference to FIGS. 7-9, an installation and landing sequence for the hanger system 110 will now be described. As discussed above, the hanger body 120 is landed in the wellhead component by engaging the landing ring 122 with an upwardly facing shoulder in the wellhead component. When landed, the hanger body 130 can be locked in place in the wellhead component using a locking mechanism, such as a tie down screw, lock ring, lockscrew, snap ring, or any other suitable locking mechanism. Run concurrently with or separately from the hanger body 130 are the inner mandrel 130 and production tubing on the running tool. If not already disengaged from the hanger body 120, the inner mandrel 130 is disengaged by orienting the mandrel segments 138 with the gaps between the body segments 129 and passed from within the hanger body 130 into the well below the hanger body 130. The inner mandrel 130 is lowered until the packer is located its designated position within the well, where the packer is then set to seal the annulus surrounding the production tubing as well as anchor the production tubing in the well.

The running tool is then used to raise the inner mandrel 130 into the hanger body 120, placing the production tubing string in tension. The inner mandrel 130 is raised in an orientation such that the load pin(s) 127 is inserted into the slot 132 or one of the slots 132 in the inner mandrel 130 such that the inner mandrel 130 is engaged with the hanger body 120. The inner mandrel 130 is raised by moving axially relative to the hanger body 120 with the load pin 127 travelling within the helically oriented portion 136 of the slot 132 until the load pin reaches the axially oriented portion 134 of the slot 132. The running tool is used to rotate the inner mandrel 130 relative to the hanger body 130 as it moves axially to cause the load pin 127 to travel into the axially oriented portion 134 of the slot 132 and out of the helically oriented portion 136. In the embodiment shown in FIGS. 7-9, but not necessarily all embodiments, the helically oriented portion 134 of the slot 132 allows for the inner mandrel 130 to be simultaneously rotatable as well as movable axially relative to the hanger body 120. Thus, the inner mandrel 130 is engageable with the hanger body 120 by rotation of the inner mandrel 30.

Rotation and axially movement of the inner mandrel 130 is continued until the load pin 127 passed into the axially oriented portion 134 of the slot 132. With the load pin 127 in the oriented portion 134, the inner mandrel 130 is movable into a landed position by axial, non-rotational movement of the inner mandrel 130 downward relative to the hanger body 120. Because the production tubing string is anchored in position with the packer, raising the inner mandrel 130 places the production tubing in tension. Downward movement of the inner mandrel 130 is accomplished by lowering the inner mandrel 130 on the running tool. However, the production hanger system 110 and production tubing may be engineered such that even with the inner mandrel 130 in the landed position, the production tubing string remains in tension. Thus, the inner mandrel 130 is capable of axial movement relative to the hanger body 130 with the load pin located in the axially oriented portion 134 of the slot 132. Because of the rotational movement of the inner mandrel 130 relative to the hanger body 120 however, the inner mandrel is moved out of the orientation for passing the body segments 129. Thus when lowered out of the orientation, the inner mandrel 130 is supportable in a landed position by engagement of the mandrel segments 138 and the body segments 129. As shown in FIG. 7, in the landed position, the downwardly facing shoulder 139 of the mandrel segments 138 may engage the upwardly facing shoulders of the body segments 129 such that the weight and tension of the tubing string and inner mandrel 130 are supported on the hanger body 120 and ultimately the wellhead component. Similarly to the embodiment discussed above and shown in FIG. 6, once the inner mandrel 130 is landed in the hanger body 120, a seal flange or other element may be connected with the wellhead component to lock the inner mandrel 130 in the landed position.

Although the present invention has been described with respect to specific details, it is not intended that such details should be regarded as limitations on the scope of the invention, except to the extent that they are included in the accompanying claims.

What is claimed is:

1. A hanger system for supporting a production tubing string in a well, the system comprising:

a hanger body comprising an inner bore extending therethrough along an axis;

an inner mandrel attachable to the production tubing string and comprising an exterior surface comprising a slot, the slot comprising an axially oriented portion that terminates and the slot continues into either an azimuthally oriented portion or a helically oriented portion extending from the axially oriented portion, the inner mandrel being passable from the hanger body inner bore; and wherein the inner mandrel is movable into a landed position by axial and rotational movement of the inner mandrel relative to the hanger body, the axial and rotational movement being guided by the slot.

2. The system of claim 1 wherein the inner mandrel comprises the azimuthally oriented portion and is rotatable without axial movement relative to the hanger body.

3. The system of claim 1 further comprising a sleeve comprising a load pin extended into the interior of the sleeve and wherein the inner mandrel comprises the azimuthally oriented portion and is engageable with the hanger body by inserting the load pin in the slot.

4. The system of claim 3 wherein the sleeve is restrained from rotation relative to the hanger body.

5. The system of claim 3 wherein the inner mandrel is capable of axial movement relative to the hanger body with the load pin located in the axially oriented portion and the inner mandrel is capable of rotational movement relative to the hanger body with the load pin located in the azimuthally oriented portion.

6. The system of claim 3 further comprising:

a ring collapsible radially inward;

wherein the sleeve is movable axially upon axial movement of the inner mandrel with the load pin inserted in the slot; and wherein the ring is collapsible radially inward upon axial movement of the sleeve over the ring to create a shoulder to support the inner mandrel in the landed position.

7. The system of claim 1 further comprising a load pin extended into the interior of the hanger body axial bore and wherein the inner mandrel is engageable with the hanger body by inserting the load pin in the slot.

8. The system of claim 7 wherein:

the slot comprises the helically oriented portion;

wherein the inner mandrel is rotatably and axially moveable relative to the hanger body with the load pin located in the helically oriented portion; and wherein the inner mandrel is axially movable relative to the hanger body with the load pin located in the axially oriented portion.

9. The system of claim 7 further comprising:

the inner mandrel comprising the helically oriented portion and comprising mandrel segments extending from the mandrel exterior surface;

the hanger body comprising body segments extending into the inner bore; and wherein the mandrel is passable from and into the hanger body when the mandrel segments are aligned relative to the body segments in an orientation.

10. The system of claim 9 wherein the inner mandrel is supportable in the landed position when the mandrel segments are rotated out of the orientation by engagement of the mandrel segments and the body segments.

11. A well production system for producing fluids from a well, the system comprising:

a wellhead component;

a hanger system comprising:

a hanger body comprising an inner bore extending therethrough along an axis;

an inner mandrel comprising an exterior surface comprising a slot, the slot comprising an axially oriented portion that terminates and the slot continues into either an azimuthally oriented portion or a helically oriented portion extending from the axially oriented portion, the inner mandrel being passable from the hanger body inner bore; and wherein the inner mandrel is movable into a landed position by axial and rotational movement of the inner mandrel relative to the hanger body, the axial and rotational movement being guided by the slot; and a production tubing string attachable to the inner mandrel and extendable into the well.

12. The system of claim 11 wherein the inner mandrel comprises the azimuthally oriented portion and is rotatable without axial movement relative to the hanger body.

13. The system of claim 11 further comprising a sleeve comprising a load pin extended into the interior of the sleeve and wherein the inner mandrel comprises the azimuthally oriented portion and is engageable with the hanger body by inserting the load pin in the slot.

14. The system of claim 13 wherein the sleeve is restrained from rotation relative to the hanger body.

15. The system of claim 13 wherein the inner mandrel is capable of axial movement relative to the hanger body with the load pin located in the axially oriented portion and the inner mandrel is capable of rotational movement relative to the hanger body with the load pin located in the azimuthally oriented portion.

16. The system of claim 13 further comprising:

a ring collapsible radially inward;

wherein the sleeve is movable axially upon axial movement of the inner mandrel with the load pin inserted in the slot; and wherein the ring is collapsible radially inward upon axial movement of the sleeve over the ring to create a shoulder to support the inner mandrel in the landed position.

17. The system of claim 11 further comprising a load pin extended into the interior of the hanger body axial bore and wherein the inner mandrel is engageable with the hanger body by inserting the load pin in the slot.

18. The system of claim 17 wherein:

the slot comprises the helically oriented portion;

wherein the inner mandrel is rotatably and axially moveable relative to the hanger body with the load pin located in the helically oriented portion; and wherein the inner mandrel is axially moveable relative to the hanger body with the load pin located in the axially oriented portion.

19. The system of claim 17 further comprising:

the inner mandrel comprising the helically oriented portion and comprising mandrel segments extending from the mandrel exterior surface;

the hanger body comprising body segments extending into the inner bore; and wherein the mandrel is passable from and into the hanger body when the mandrel segments are aligned relative to the body segments in an orientation.

20. The system of claim 19 wherein the inner mandrel is supportable in the landed position when the mandrel segments are rotated out of the orientation by engagement of the mandrel segments and the body segments.

* * * * *